US011520258B2

(12) United States Patent
Kamoda

(10) Patent No.: US 11,520,258 B2
(45) Date of Patent: Dec. 6, 2022

(54) IMAGE FORMING APPARATUS WITH LUBRICANT SUPPLIER

(71) Applicant: Konica Minolta, Inc., Tokyo (JP)

(72) Inventor: Yuji Kamoda, Ibaraki (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/371,784

(22) Filed: Jul. 9, 2021

(65) Prior Publication Data

US 2022/0057733 A1 Feb. 24, 2022

(30) Foreign Application Priority Data

Aug. 21, 2020 (JP) ..... JP2020-140285

(51) Int. Cl.
*G03G 15/20* (2006.01)
*G03G 21/00* (2006.01)

(52) U.S. Cl.
CPC ..... *G03G 15/2025* (2013.01); *G03G 21/0094* (2013.01)

(58) Field of Classification Search
CPC ..... G03G 15/2025; G03G 21/0094
See application file for complete search history.

(56) References Cited

U.S. PATENT DOCUMENTS

2010/0251916 A1 10/2010 Peles et al.
2017/0336750 A1* 11/2017 Haga ..... G03G 21/0094
2019/0219961 A1* 7/2019 Kashiwakura ..... G03G 21/0094
2019/0278213 A1* 9/2019 Kawakami ..... G03G 21/0094

FOREIGN PATENT DOCUMENTS

JP 2019-8276 A 1/2019

OTHER PUBLICATIONS

Extended European Search Report (EESR) dated Jan. 5, 2022 for corresponding European Patent Application No. 21190915.5.

* cited by examiner

*Primary Examiner* — Sandra Brase
(74) *Attorney, Agent, or Firm* — Rankin, Hill & Clark LLP

(57) ABSTRACT

An image forming apparatus includes: a lubricant supplier that supplies a lubricant onto an image carrier; a fixing member that is rotatable, and comes into contact with the image carrier to fix the lubricant supplied onto the image carrier; and a hardware processor that controls rotation of the fixing member.

19 Claims, 11 Drawing Sheets

| AVERAGE PRINTING RATE | ORDINAL NUMBER AT WHICH FIRST REFRESH OPERATION IS EXECUTED |
|---|---|
| LOWER THAN 10% | 100K |
| EQUAL TO OR HIGHER THAN 10% | 200K |

FIG. 12
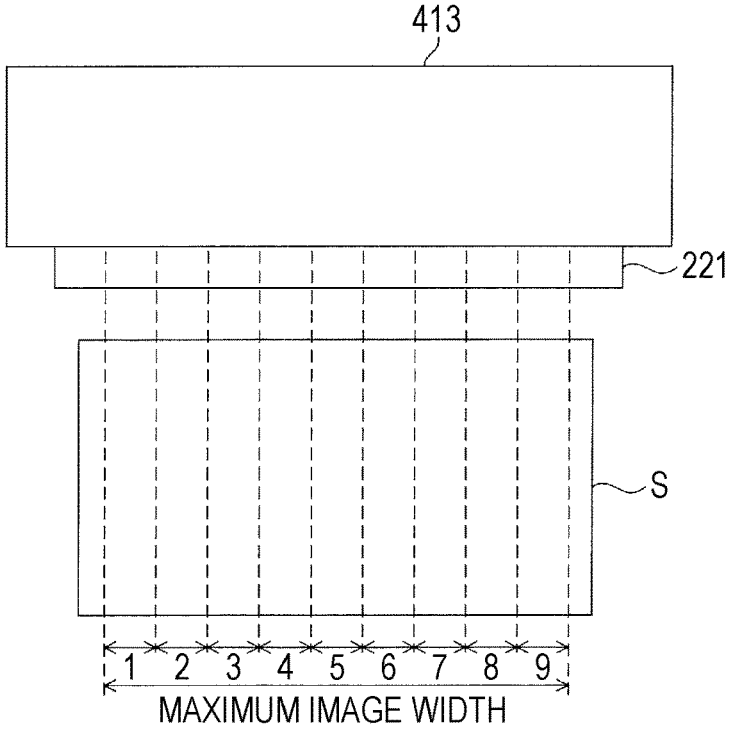
FIG. 13
| ENTIRE SECTION AVERAGE VALUE OF AVERAGE PRINTING RATE | ROTATION DIRECTION IN FIRST REFRESH OPERATION |
|---|---|
| LOWER THAN 30% | FOLLOWING |
| EQUAL TO OR HIGHER THAN 30% | COUNTER |
FIG. 14
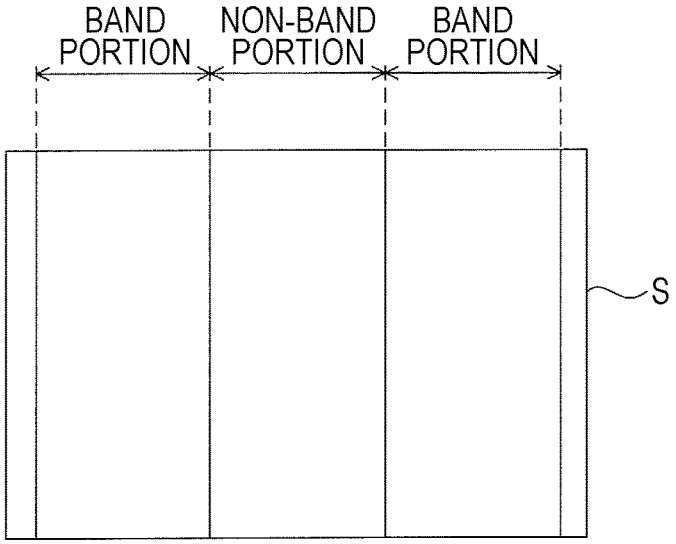

FIG. 15

| FIG. 15A | FIG. 15B |
|---|---|

FIG. 15A

| | IMAGE CHART | 100K | | | 200K | |
|---|---|---|---|---|---|---|
| | | FIRST REFRESH OPERATION | IMAGE DENSITY FLUCTUATION | IMAGE NOISE | FIRST REFRESH OPERATION | IMAGE DENSITY FLUCTUATION |
| COMPARATIVE EXAMPLE 1 | LATERAL BANDS BELT 5% | — | △ | ○ | — | × |
| | LATERAL BANDS BELT 20% | | ○ | ○ | | △ |
| | LONGITUDINAL BANDS BAND 60% | | △ | △ | | × |
| EXAMPLE 1 | LATERAL BANDS BELT 5% | UNEXECUTED | △ | ○ | EXECUTED (COUNTER) | ○ |
| | LATERAL BANDS BELT 20% | | ○ | ○ | | ○ |
| | LONGITUDINAL BANDS BAND 60% | | △ | △ | | ○ |
| EXAMPLE 2 | LATERAL BANDS BELT 5% | EXECUTED (COUNTER) | ○ | ○ | EXECUTED (COUNTER) | ○ |
| | LATERAL BANDS BELT 20% | UNEXECUTED | ○ | ○ | EXECUTED (COUNTER) | ○ |
| | LONGITUDINAL BANDS BAND 60% | UNEXECUTED | △ | △ | EXECUTED (COUNTER) | ○ |
| EXAMPLE 3 | LATERAL BANDS BELT 5% | EXECUTED (COUNTER) | ○ | ○ | EXECUTED (COUNTER) | ○ |
| | LATERAL BANDS BELT 20% | UNEXECUTED | ○ | ○ | EXECUTED (COUNTER) | ○ |
| | LONGITUDINAL BANDS BAND 60% | EXECUTED (COUNTER) | ○ | ○ | EXECUTED (COUNTER) | ○ |
| EXAMPLE 4 | LATERAL BANDS BELT 5% | EXECUTED (FOLLOWING) | ○ | ○ | EXECUTED (FOLLOWING) | ○ |
| | LATERAL BANDS BELT 20% | UNEXECUTED | ○ | ○ | EXECUTED (FOLLOWING) | ○ |
| | LONGITUDINAL BANDS BAND 60% | UNEXECUTED | △ | △ | EXECUTED (COUNTER) | ○ |

TO FIG. 15B

FROM FIG. 15A

FIG. 15B

| NUMBER OF ENDURABLE SHEETS | | | | | | | |
|---|---|---|---|---|---|---|---|
| | 300K | | | 400K | | | |
| IMAGE NOISE | FIRST REFRESH OPERATION | IMAGE DENSITY FLUCTUATION | IMAGE NOISE | FIRST REFRESH OPERATION | IMAGE DENSITY FLUCTUATION | IMAGE NOISE | LUBRICANT CONSUMPTION RATE |
| ○ | — | — | — | | | | |
| ○ | | × | ○ | | | | |
| × | | — | — | | | | |
| ○ | UNEXECUTED | △ | ○ | EXECUTED (COUNTER) | ○ | ○ | 48% |
| ○ | | ○ | ○ | | ○ | ○ | 61% |
| ○ | | △ | △ | | ○ | ○ | 83% |
| ○ | EXECUTED (COUNTER) | ○ | ○ | EXECUTED (COUNTER) | ○ | ○ | 46% |
| ○ | UNEXECUTED | ○ | ○ | EXECUTED (COUNTER) | ○ | ○ | 62% |
| ○ | UNEXECUTED | △ | △ | EXECUTED (COUNTER) | ○ | ○ | 80% |
| ○ | EXECUTED (COUNTER) | ○ | ○ | EXECUTED (COUNTER) | ○ | ○ | 45% |
| ○ | UNEXECUTED | ○ | ○ | EXECUTED (COUNTER) | ○ | ○ | 60% |
| ○ | EXECUTED (COUNTER) | ○ | ○ | EXECUTED (COUNTER) | ○ | ○ | 77% |
| ○ | EXECUTED (FOLLOWING) | ○ | ○ | EXECUTED (FOLLOWING) | ○ | ○ | 36% |
| ○ | UNEXECUTED | ○ | ○ | EXECUTED (FOLLOWING) | ○ | ○ | 56% |
| ○ | UNEXECUTED | △ | △ | EXECUTED (COUNTER) | ○ | ○ | 80% |

FIG. 16

| | NUMBER OF SHEETS REQUIRED FOR IMAGE NOISE TO DISAPPEAR |
|---|---|
| COMPARATIVE EXAMPLE 1 | 21 |
| EXAMPLE 5 | 12 |
| EXAMPLE 6 | 0 |

IMAGE FORMING APPARATUS WITH LUBRICANT SUPPLIER

The entire disclosure of Japanese patent Application No. 2020-140285, filed on Aug. 21, 2020, is incorporated herein by reference in its entirety.

BACKGROUND

Technological Field

The present invention relates to an image forming apparatus.

Description of the Related Art

An electrophotographic image forming apparatus (a printer, a copier, a facsimile, a multifunction machine having functions thereof, or the like) includes a cleaning device with a cleaning blade that removes toner remaining on an image carrier such as a photoconductor drum. In addition, there is also an image forming apparatus including a lubricant supply device that supplies a lubricant as a lubricating agent onto the image carrier in order to reduce a frictional force between the image carrier and the cleaning blade. The lubricant supply device as described above includes a lubricant rod in which the lubricant is formed in a rod shape, a brush that supplies the lubricant of the lubricant rod to the image carrier, a fixing blade that fixes the lubricant supplied onto the image carrier, and the like (see, for example, JP 2019-8276 A).

Incidentally, wear of the fixing blade usually used for fixing the lubricant progresses, for example, due to sliding between the fixing blade and the image carrier, and thus a contact state between the fixing blade and the image carrier changes with the lapse of a use time from an initial use. Specifically, as the wear of the fixing blade progresses, a contact pressure at a contact nip between the fixing blade and the image carrier (for example, the maximum contact pressure at the contact nip) decreases. When the contact pressure at the contact nip decreases, the fixing blade cannot sufficiently fix the lubricant supplied onto the image carrier, and the amount of lubricant passing through the fixing blade without being fixed increases.

The lubricant insufficiently fixed to the image carrier as described above is easily collected on a side of a developing device when passing through a portion of a developing roller of the developing device. When the lubricant insufficiently fixed is collected on the side of the developing device, the amount of lubricant on the image carrier decreases. In this case, for example, the image carrier is easily affected by abrasion with the side of the developing roller, and a surface potential on the image carrier easily fluctuates as compared with a case where the amount of lubricant on the image carrier does not decrease. As a result, there is a problem that the surface potential on the image carrier may fluctuate, and furthermore, the amount of toner supplied from the developing roller to the image carrier may fluctuate, which may cause the density of a finally formed image, that is, the quality of the image to fluctuate.

SUMMARY

An object of the present invention is to provide an image forming apparatus capable of suppressing deterioration in quality of a formed image.

To achieve the abovementioned object, according to an aspect of the present invention, an image forming apparatus reflecting one aspect of the present invention comprises: a lubricant supplier that supplies a lubricant onto an image carrier; a fixing member that is rotatable, and comes into contact with the image carrier to fix the lubricant supplied onto the image carrier; and a hardware processor that controls rotation of the fixing member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 12 is a diagram for describing divided regions set by dividing the maximum image width in the axial direction of the photoconductor drum;

FIG. 13 is a table illustrating conditions for controlling a rotation direction of the fixing roller based on an entire section average value of the average printing rate;

FIG. 14 is a diagram illustrating longitudinal bands used in evaluation methods of Comparative Example 1 and Examples 1 to 4;

FIGS. 15A and 15B are tables illustrating evaluation results of Comparative Example 1 and Examples 1 to 4; and FIG. 16 is a table illustrating evaluation results of Comparative Example 1 and Examples 5 and 6.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
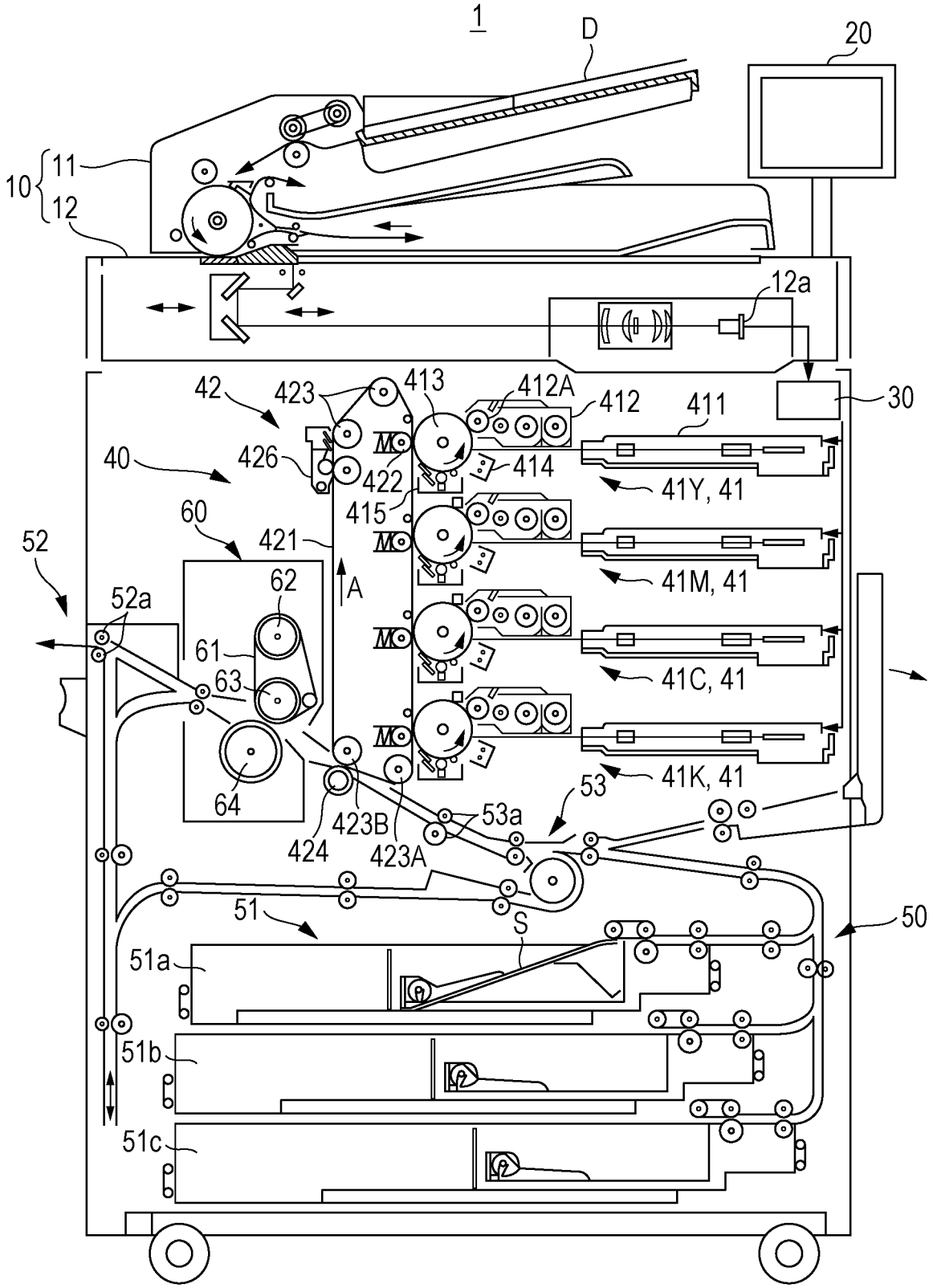
FIG. 1 is a diagram schematically illustrating an overall configuration of an image forming apparatus according to an embodiment of the present invention.
Figure 2:
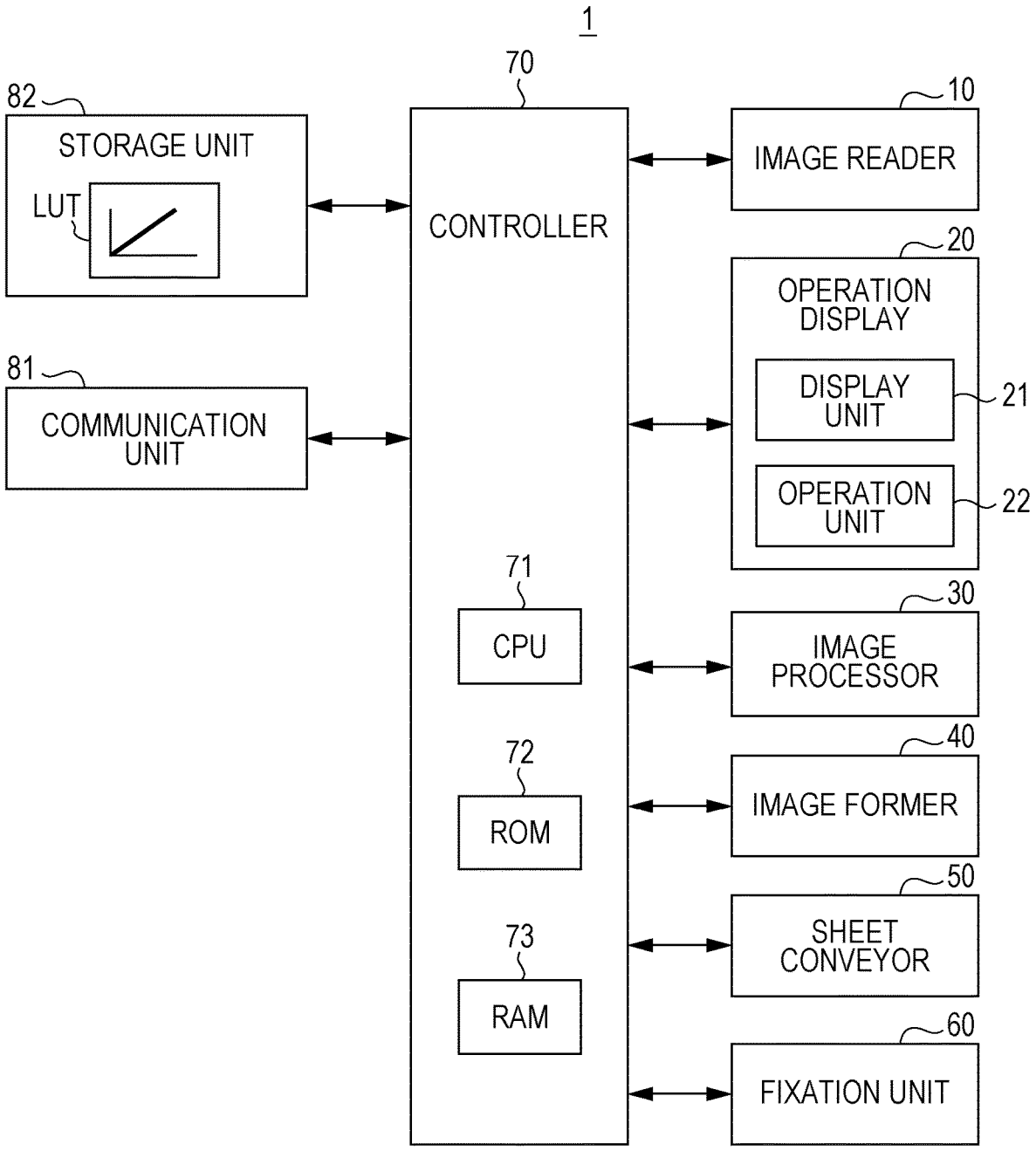
FIG. 2 is a diagram illustrating a main part of a control system of the image forming apparatus according to the embodiment of the present invention.

FIG. 1 is a diagram schematically illustrating an overall configuration of an image forming apparatus 1 according to the present embodiment. FIG. 2 is a diagram illustrating a main part of a control system of the image forming apparatus 1 according to the present embodiment.

As illustrated in FIG. 1, the image forming apparatus 1 is an intermediate transfer-type color image forming apparatus using an electrophotographic process technology. That is, the image forming apparatus 1 primarily transfers toner images of respective colors of cyan (C), magenta (M), yellow (Y), and black (K) formed on photoconductors to an intermediate transfer body, superimposes the toner images of the four colors on the intermediate transfer body, and then secondarily transfers the toner images to a sheet, thereby forming an image.

In addition, the image forming apparatus 1 employs a tandem system in which the photoconductors corresponding to the four colors of CMYK are arranged in series in a traveling direction of the intermediate transfer body, and the toner images of respective colors are sequentially transferred to the intermediate transfer body in a single procedure.

The image forming apparatus 1 illustrated in FIGS. 1 and 2 includes an image reader 10, an operation display 20, an image processor 30, an image former 40, a sheet conveyor 50, a fixation unit 60, a controller 70, and the like.

The controller 70 includes a central processing unit (CPU) 71, a read only memory (ROM) 72, a random access memory (RAM) 73, and the like. The CPU 71 reads a program corresponding to processing contents from the ROM 72, develops the program in the RAM 73, and centrally controls an operation of each block of the image forming apparatus 1 in cooperation with the developed program. At this time, various types of data such as a look up table (LUT) stored in a storage unit 82 are referred to. The storage unit 82 includes, for example, a nonvolatile semiconductor memory (so-called flash memory) or a hard disk drive.

The controller 70 transmits and receives various types of data to and from an external device (for example, a personal computer) connected to a communication network such as a local area network (LAN) or a wide area network (WAN) via a communication unit 81. For example, the controller 70 receives image data transmitted from the external device, and forms an image on a sheet based on the image data (input image data). The communication unit 81 includes, for example, a communication control card such as a LAN card.

The image reader 10 includes an automatic document feeding device 11 called an auto document feeder (ADF), a document image scanning device 12 (scanner), and the like.

The automatic document feeding device 11 conveys a document D placed on a document tray by a conveying mechanism and sends the document D to the document image scanning device 12. The automatic document feeding device 11 can continuously read images (including images of both sides) of a large number of documents D placed on the document tray at once.

The document image scanning device 12 optically scans a document conveyed onto a contact glass from the automatic document feeding device 11 or a document placed on the contact glass, and forms an image of reflected light from the document on a charge coupled device (CCD) sensor 12*a* to read a document image. The image reader 10 generates the input image data based on a reading result by the document image scanning device 12. The input image data is subjected to predetermined image processing in the image processor 30.

The operation display 20 includes, for example, a liquid crystal display (LCD) with a touch panel, and functions as a display unit 21 and an operation unit 22. The display unit 21 displays various operation screens, an image state, an operation status of each function, and the like according to a display control signal input from the controller 70. The operation unit 22 includes various operation keys such as a numeric keypad and a start key, receives various input operations by a user, and outputs an operation signal to the controller 70.

The image processor 30 includes a circuit that performs image processing on the input image data according to initial settings or user settings. The image former 40 is controlled based on the image data subjected to the image processing.

The image former 40 includes image forming units 41Y, 41M, 41C, and 41K, an intermediate transfer unit 42, and the like. The image forming units 41Y, 41M, 41C, and 41K form images with respective color toners of the Y component, the M component, the C component, and the K component based on the image data from the image processor 30.

The image forming units 41Y, 41M, 41C, and 41K for the Y component, the M component, the C component, and the K component have similar configurations. Therefore, in FIG. 1, only components of the image forming unit 41Y for the Y component are denoted by reference signs, and reference signs of components of the other image forming units 41M, 41C, and 41K are omitted.

The image forming unit 41 includes an exposure device 411, a developing device 412, a photoconductor drum 413 (image carrier), a charging device 414, a drum cleaning unit (hereinafter, cleaning unit) 415, and the like.

The exposure device 411 includes, for example, a semiconductor laser, and irradiates the photoconductor drum 413 with laser light corresponding to an image of each color component. When a positive charge is generated in a charge generation layer of the photoconductor drum 413 by irradiation with the laser light and transported to a surface of a charge transport layer, a surface charge (negative charge) of the photoconductor drum 413 is neutralized. As a result, an electrostatic latent image of each color component is formed on a surface of the photoconductor drum 413 due to a potential difference from the surroundings.

The developing device 412 is, for example, a developing device using a two-component developing system. The developing device 412 includes a developing roller 412A and the like, and attaches the toner of each color component from the developing roller 412A to the surface of the photoconductor drum 413 to visualize the electrostatic latent image, thereby forming a toner image.

The photoconductor drum 413 includes, for example, a conductive cylindrical body made of aluminum (aluminum tube), an undercoat layer (UCL), the charge generation layer (CGL), the charge transport layer (CTL), and the like. The photoconductor drum 413 is a photoconductor having photoconductivity, is configured by sequentially laminating the undercoat layer, the charge generation layer, and the charge transport layer on a peripheral surface of the conductive cylindrical body, and is, for example, a negative charge type organic photoconductor (OPC). The photoconductor drum 413 is rotated at a constant peripheral speed (linear speed) by the controller 70 controlling a drive current supplied to a drive motor (not illustrated) of the photoconductor drum 413.

The charging device 414 uniformly charges, to a negative polarity, the surface of the photoconductor drum 413 having photoconductivity.

The cleaning unit 415 includes a drum cleaning blade (hereinafter, cleaning blade) as a cleaning member that is in sliding contact with the surface of the photoconductor drum 413. The cleaning unit 415 removes, by the cleaning blade, transfer residual toner remaining on the surface of the photoconductor drum 413 after the primary transfer. A more detailed configuration of the cleaning unit 415 will be described later with reference to FIG. 3.

The intermediate transfer unit 42 includes an intermediate transfer belt 421, a primary transfer roller 422, a plurality of support rollers 423 including a driving roller 423A and a backup roller 423B, a secondary transfer roller 424, a belt cleaning device 426, and the like.

The intermediate transfer belt 421 is stretched around the plurality of support rollers 423 in a loop shape, and the intermediate transfer belt 421 travels at a constant speed in a direction of an arrow A by the driving roller 423A rotating. The primary transfer roller 422 presses the intermediate transfer belt 421 against the photoconductor drum 413, thereby transferring the toner image from the photoconductor drum 413 to the intermediate transfer belt 421. The secondary transfer roller 424 is pressed against the backup roller 423B with the intermediate transfer belt 421 interposed therebetween, thereby transferring the toner image from the intermediate transfer belt 421 to a sheet S. The sheet S to which the toner image has been transferred is conveyed toward the fixation unit 60. Note that, instead of the secondary transfer roller 424, a belt-type secondary transfer unit in which a secondary transfer belt is stretched around a plurality of support rollers in a loop shape may be employed.

The belt cleaning device 426 includes a belt cleaning blade in sliding contact with a surface of the intermediate transfer belt 421 and the like, and removes transfer residual toner remaining on the surface of the intermediate transfer belt 421 after the secondary transfer.

The sheet conveyor 50 includes a sheet feeder 51, a sheet discharger 52, a conveyance path 53, and the like. In three sheet feed tray units 51*a* to 51*c* included in the sheet feeder 51, sheets S (standard sheets or special sheets) identified based on a basis weight, size, and the like are stored for each preset type. The conveyance path 53 includes a plurality of conveyance roller pairs such as a resist roller pair 53*a*.

The sheets S stored in the sheet feed tray units 51*a* to 51*c* are sent out one by one from the top, and are conveyed to the image former 40 by the conveyance path 53. At this time, a resist roller unit in which the resist roller pair 53*a* is disposed corrects inclination of the fed sheet S and adjusts a conveyance timing. The sheet S on which the image has been formed through the image former 40 and the fixation unit 60 is discharged to the outside of the apparatus by the sheet discharger 52 including a sheet discharge roller 52*a*.

The fixation unit 60 heats and pressurizes, at a fixation nip, the conveyed sheet S on which the toner image has been secondarily transferred to fix the toner image on the sheet S. The fixation unit 60 includes a fixation belt 61, a heating roller 62, a fixation roller 63, a pressure roller 64, and the like. The fixation belt 61 is stretched by the heating roller 62 and the fixation roller 63. The pressure roller 64 forms the fixation nip that holds and conveys the sheet S together with the fixation belt 61.

Figure 3:
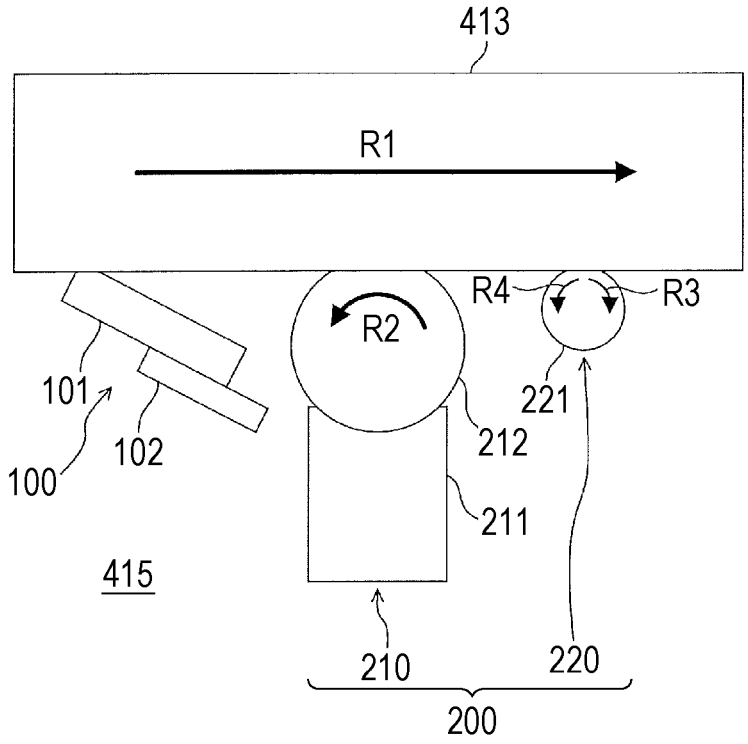
FIG. 3 is a diagram illustrating an example of a drum cleaning unit of the image forming apparatus illustrated in FIG. 1.

FIG. 3 is a diagram illustrating an example of the cleaning unit 415. The cleaning unit 415 includes a cleaning device 100, a lubricant supplier 210, a fixing device 220, and the like. These are attached to and housed in a support frame (not illustrated). In the present embodiment, the lubricant supplier 210 and the fixing device 220 constitute a lubricant supply device 200.

The cleaning device 100 includes a cleaning blade 101 and a support sheet metal 102. The cleaning blade 101 is attached to and supported by the support sheet metal 102. The support sheet metal 102 is attached to and supported by the support frame (not illustrated). The cleaning blade 101 is formed by an elastic member such as urethane rubber being molded into a flat sheet, and has a width substantially equal to the width of the photoconductor drum 413 in an axial direction (main scanning direction). Here, the cleaning blade 101 has a counter type configuration in which a tip (edge) of the cleaning blade 101 is brought into contact with the photoconductor drum 413 so as to face a rotation direction R1 of the photoconductor drum 413. Specifically, when the photoconductor drum 413 rotates in the rotation direction R1, the cleaning blade 101 is arranged so as to be in sliding contact with the photoconductor drum 413 at a predetermined contact angle and pushing depth from a counter direction in which the tip portion of the cleaning blade 101 is stretched.

At the time of image formation, the transfer residual toner remaining on the surface of the photoconductor drum 413 is scraped off by the cleaning blade 101 with the rotation of the photoconductor drum 413 in the rotation direction R1.

The lubricant supplier 210 includes a lubricant rod 211 and a brush 212. The lubricant rod 211 is formed by a lubricating agent being solidified into a rod shape. The lubricant rod 211 is supported by a holder including a biasing member (neither illustrated) and is fixed to the support frame. The biasing member is, for example, a compression spring, and presses the lubricant rod 211 toward the brush 212 with a predetermined pressing load in order to maintain a state where the lubricant rod 211 is in contact with the brush 212. The width of the lubricant rod 211 is narrower than the width of the cleaning blade 101 or the like. The lubricant rod 211 has, for example, a hardness equivalent to a pencil hardness of F to HB. The lubricating agent used for the lubricant rod 211 is, for example, zinc stearate (ZnSt).

The brush 212 serves to supply the lubricant of the lubricant rod 211 onto the photoconductor drum 413.

The brush 212 is, for example, a roller-shaped brush obtained by winding, around a core metal, a base fabric in which fibers such as polyester are implanted, and has a width substantially equal to the axial width of the photoconductor drum 413. The brush 212 is arranged so as to be in contact with a surface of the lubricant rod 211 and the surface of the photoconductor drum 413, and rotates in a rotation direction R2 opposite to the rotation direction R1 of the photoconductor drum 413 to supply the lubricant onto the photoconductor drum 413.

The fixing device 220 is arranged on the downstream side of the lubricant supplier 210 in the rotation direction R1 of the photoconductor drum 413, and fixes the lubricant supplied onto the photoconductor drum 413 by the lubricant supplier 210.

Figures 10, 11:
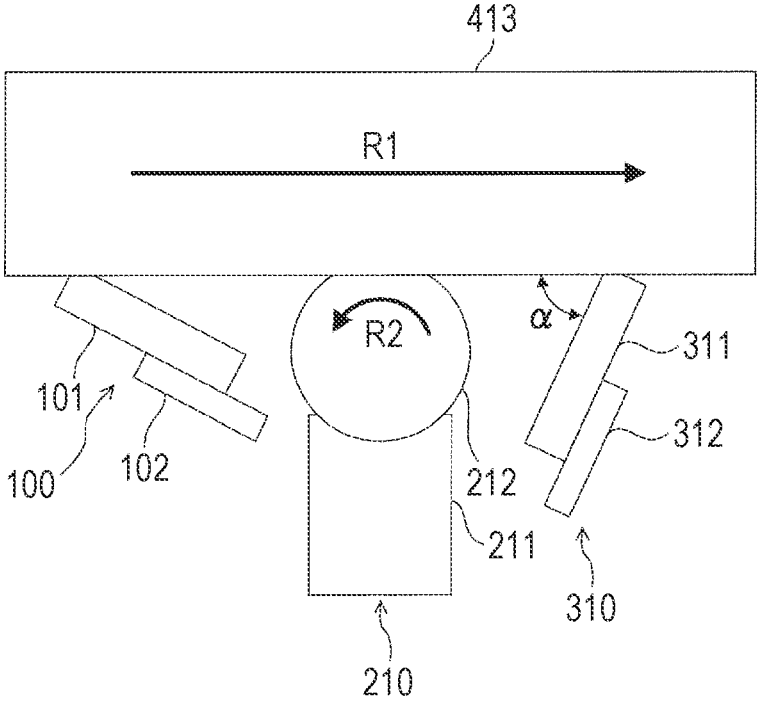
FIG. 10 Prior Art
FIG. 10 is a diagram illustrating a drum cleaning unit including a conventional lubricant supply device and a conventional fixing device.
FIG. 11 is a table illustrating conditions for executing a first refresh operation based on an average printing rate and a total number of printed sheets.

Conventionally, in a fixing device that fixes a lubricant, a fixing blade 311 as illustrated in FIG. 10 to be described later has been used. Wear of the fixing blade 311 progresses due to sliding between the fixing blade 311 and the photoconductor drum 413. As the wear of the fixing blade 311 progresses, the amount of lubricant passing through the fixing blade 311 without being fixed increases.

The lubricant insufficiently fixed to the photoconductor drum 413 is easily collected on a side of the developing device 412 when passing through a portion of the developing roller 412A of the developing device 412. When the lubricant insufficiently fixed is collected on the side of the developing device 412, the amount of lubricant on the photoconductor drum 413 decreases. In this case, for example, the photoconductor drum 413 is easily affected by abrasion with the side of the developing roller 412A, and a surface potential on the photoconductor drum 413 easily fluctuates. As a result, there is a problem that the surface potential on the photoconductor drum 413 may fluctuate, and furthermore, the amount of toner supplied from the developing roller 412A to the photoconductor drum 413 may fluctuate, which may cause the density of a finally formed image, that is, the quality of the image to fluctuate.

Therefore, in the present embodiment, the fixing device 220 includes a fixing member (see a fixing roller 221 illustrated in FIG. 3) that is rotatable, and comes into contact with the photoconductor drum 413 to fix the lubricant supplied onto the photoconductor drum 413. Furthermore, the fixing device 220 includes the controller 70 (see FIG. 2) that controls rotation of the fixing member. When the lubricant is fixed by the fixing member, the controller 70 stops the rotation of the fixing member. The controller 70 then rotates the fixing member according to a wear state of a contact region of the fixing member in contact with the photoconductor drum 413, to bring a region of the fixing member different from the contact region into contact with the photoconductor drum 413.

The fixing device 220 having such a configuration will be described with reference to FIG. 3. As illustrated in FIG. 3, the fixing device 220 includes the fixing roller 221 as the fixing member. The fixing device 220 also includes a support member, a motor, and the like, which are not illustrated.

The fixing roller 221 has a width substantially equal to the axial width of the photoconductor drum 413. The fixing roller 221 is rotatably attached to and supported by the support member. The support member is attached to and supported by the support frame. The fixing roller 221 is pressed toward the photoconductor drum 413 with a predetermined pressing force by the support member and is brought into contact with the photoconductor drum 413, thereby forming a contact nip and securing a predetermined nip width. At this time, the fixing roller 221 is pressed toward the photoconductor drum 413 such that the nip width (surface pressure) of the fixing roller 221 and a wedge angle at which the lubricant enters the contact nip are equal to or larger than those of a conventionally used fixing blade.

The fixing roller 221 is driven by the motor, and the motor is driven by the controller 70. Specifically, the controller 70 drives the motor by outputting a drive signal to rotate the fixing roller 221 in a rotation direction R3 or a rotation direction R4. The controller 70 stops the motor by stopping the output of the drive signal, and stops the rotation of the fixing roller 221. In this manner, the controller 70 controls the motor to control the rotation operation of the fixing roller 221.

Figure 4:
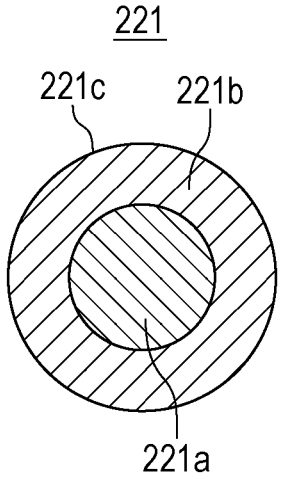
FIG. 4 is a cross-sectional view illustrating an example of a configuration of a fixing roller.

A configuration of the fixing roller 221 will be described with reference to FIG. 4. FIG. 4 is a cross-sectional view illustrating an example of the configuration of the fixing roller 221.

The fixing roller 221 has a columnar shape or a cylindrical shape, and includes a core metal 221*a*, an elastic layer 221*b*, and a surface layer 221*c*. The core metal 221*a* is a columnar body or a cylindrical body made of metal. The elastic layer 221*b* is provided on an outer peripheral surface of the core metal 221*a*, and is formed of an elastic member such as rubber. The surface layer 221*c* is a layer that covers an outer peripheral surface of the elastic layer 221*b*, and is formed of an elastic member.

The fixing device 220 having the above-described configuration is operated as follows. Specifically, the controller 70 brings the fixing roller 221, which is not being rotated, into contact with the photoconductor drum 413 to fix the lubricant supplied onto the photoconductor drum 413.

In addition, the controller 70 rotates the fixing roller 221 according to a wear state of the contact nip (contact region) of the fixing roller 221 in contact with the photoconductor drum 413, to bring a region of the fixing roller 221 different from the contact region into contact with the photoconductor drum 413.

More specifically, the controller 70 obtains a moving distance of the photoconductor drum 413 from the number of rotations of the photoconductor drum 413, the number of sheets on which images are formed, or the like. When the moving distance of the photoconductor drum 413 is larger than a predetermined moving distance, the controller 70 performs a first refresh operation (fixing member control method) of rotating the fixing roller 221. As the predetermined moving distance, a moving distance in which wear of the fixing roller 221 is expected to have progressed due to abrasion with the photoconductor drum 413 is set. By the first refresh operation, the fixing roller 221 is rotated to bring an unused region of the fixing roller 221 into contact with the photoconductor drum 413. That is, the fixing roller 221 is rotated by a predetermined angle such that the unused region of the fixing roller 221 is brought into contact with the photoconductor drum 413.

As described above, when estimating that the contact nip of the fixing roller 221 is worn, the controller 70 brings the unused region of the fixing roller 221 into contact with the photoconductor drum 413. When the unused region of the fixing roller 221 is brought into contact with the photoconductor drum 413, the surface pressure of the contact nip is prevented from decreasing. As a result, the amount of lubricant to be fixed by the fixing roller 221 is prevented from decreasing, and the amount of lubricant passing through the fixing roller 221 without being fixed decreases.

As described above, since the amount of lubricant passing through the fixing roller 221 without being fixed decreases, the amount of lubricant collected on the side of the developing device 412 decreases, and the amount of lubricant on the photoconductor drum 413 does not decrease (fluctuate). Since the amount of lubricant on the photoconductor drum 413 does not fluctuate, the fluctuation in the surface potential of the photoconductor drum 413 due to abrasion or the like with the side of the developing roller 412A is also suppressed. As a result of suppressing the fluctuation in the surface potential of the photoconductor drum 413, the fluctuation in the amount of toner on the photoconductor drum 413 is also suppressed, and the fluctuation in the density of the formed image is also suppressed, so that the deterioration in the quality of the formed image can be suppressed.

In addition, when estimating that the contact nip of the fixing roller 221 is worn, the controller 70 brings the unused region of the fixing roller 221 into contact with the photoconductor drum 413, and thus, a life of the fixing roller 221 continues until the entire circumference of the fixing roller 221 is used up. The life of the fixing roller 221 is several times longer than that of a conventional fixing blade, and a life of the fixing member can be extended.

As described above, in the present embodiment, the fixing device 220 includes the fixing roller 221 that is rotatable, and comes into contact with the photoconductor drum 413 to fix the lubricant supplied onto the photoconductor drum 413, and the controller 70 that controls the rotation of the fixing member.

According to the present embodiment configured as described above, when the lubricant supplied onto the photoconductor drum 413 is fixed by the fixing roller 221, the rotation of the fixing roller 221 is stopped. When the contact region of the fixing roller 221 wears, the first refresh operation of bringing the unused region of the fixing roller 221 into contact with the photoconductor drum 413 is executed, so that the surface pressure of the contact region of the fixing roller 221 can be prevented from decreasing. Thus, the amount of lubricant to be fixed by the fixing roller 221 is prevented from decreasing, and the amount of lubricant passing through the fixing roller 221 decreases. As a result, the amount of lubricant collected on the side of the developing device 412 decreases, and the amount of lubricant on the photoconductor drum 413 does not decrease. Therefore, the fluctuation in the surface potential of the photoconductor drum 413 is suppressed, and the fluctuation in the density of the formed image is also suppressed, so that the deterioration in the quality of the formed image can be suppressed.

Note that, in the present embodiment, the fixing member is the fixing roller 221 having a colunmar or cylindrical shape, but the fixing member may have, for example, a polygonal colunmar shape as long as the fixing member is rotatable.

<First Modification>

In the above embodiment, the controller 70 obtains the moving distance of the photoconductor drum 413 from the number of rotations of the photoconductor drum 413, the number of sheets on which images are formed, or the like, and estimates the wear state of the fixing roller 221 (whether the fixing roller 221 is worn) based on the moving distance.

The present modification is different from the above embodiment in an estimation condition of the wear state of the fixing roller 221, and has a configuration similar to that in the above embodiment except for this condition. Specifically, in the present modification, the controller 70 also considers, in addition to the above moving distance, printing rate information related to a printing rate of an image formed on a sheet via the photoconductor drum 413. More specifically, the controller 70 uses, as the printing rate information, an average of the printing rate (average printing rate) of the image in the axial direction of the photoconductor drum 413.

The reason why the average printing rate in the axial direction of the photoconductor drum 413 is considered is that the amount of wear of the fixing roller 221 due to abrasion with the photoconductor drum 413 is affected by the amount of an external additive of the toner passing through the cleaning blade 101 and reaching the fixing roller 221. Specifically, as the average printing rate in the axial direction of the photoconductor drum 413 decreases, the amount of the external additive of the toner reaching the fixing roller 221 decreases. As the amount of the external additive of the toner reaching the fixing roller 221 decreases, the amount of wear of the fixing roller 221 increases. That is, as the average printing rate in the axial direction of the photoconductor drum 413 decreases, the amount of wear of the fixing roller 221 increases. As described above, the wear state of the fixing roller 221 is estimated in consideration of the average printing rate in the axial direction of the photoconductor drum 413 in addition to the moving distance of the photoconductor drum 413.

Therefore, for example, as illustrated in FIG. 11 to be described later, when the average printing rate is lower than a predetermined printing rate, an ordinal number of sheets (a numerical value corresponding to the moving distance of the photoconductor drum 413) at which the first refresh operation is executed is made smaller than when the average printing rate is equal to or higher than the predetermined printing rate. That is, the moving distance of the photoconductor drum 413, at which the first refresh operation is executed, is set according to the average printing rate.

As described above, in the present modification, the controller 70 estimates the wear state of the fixing roller 221 based on the moving distance of the photoconductor drum 413 and the average printing rate in the axial direction of the photoconductor drum 413. When it is estimated that the fixing roller 221 is worn, the first refresh operation of the above embodiment is executed.

According to the present modification configured as described above, since the wear state of the fixing roller 221 is estimated based on the moving distance of the photoconductor drum 413 and the average printing rate in the axial direction of the photoconductor drum 413, the wear state of the fixing roller 221 can be more accurately estimated. Since the first refresh operation of the above embodiment is executed based on this estimation, it is possible to obtain an effect similar to that of the above embodiment.

Note that, here, the average printing rate in the axial direction of the photoconductor drum 413 is used as the printing rate information, but another numerical value, for example, a deviation from a reference value or the like may be used as long as the numerical value is an equivalent statistical numerical value.

<Second Modification>

In the above embodiment, the controller 70 obtains the moving distance of the photoconductor drum 413 from the number of rotations of the photoconductor drum 413, the number of sheets on which images are formed, or the like, and estimates the wear state of the fixing roller 221 based on the moving distance. In the first modification, the controller 70 estimates the wear state of the fixing roller 221 in consideration of the average printing rate in the axial direction of the photoconductor drum 413.

The present modification is also different from the above embodiment in the estimation condition of the wear state of the fixing roller 221, and has a configuration similar to that in the above embodiment except for this condition. The present modification is different from the above first modification in the printing rate information used by the controller 70. Specifically, in the present modification, the controller 70 uses, as the printing rate information, a partial printing rate of an image divided in the axial direction of the photoconductor drum 413 in addition to the above moving distance. More specifically, for example, the controller 70 divides an image width into a plurality of divided regions in the axial direction of the photoconductor drum 413, and uses, as the partial printing rate, an average of a printing rate in each of the divided regions.

The reason why the average printing rate in each of the divided regions is considered is that the amount of the external additive of the toner passing through the cleaning blade 101 and reaching the fixing roller 221 varies in a width direction of the fixing roller 221 depending on an image pattern. When the amount of the external additive of the toner reaching the fixing roller 221 is different in the width direction of the fixing roller 221, the amount of wear of the fixing roller 221 is different in the width direction. As a result, the amount of lubricant on the photoconductor drum 413 becomes non-uniform in the width direction, and noise is generated in the formed image.

Figure 5:
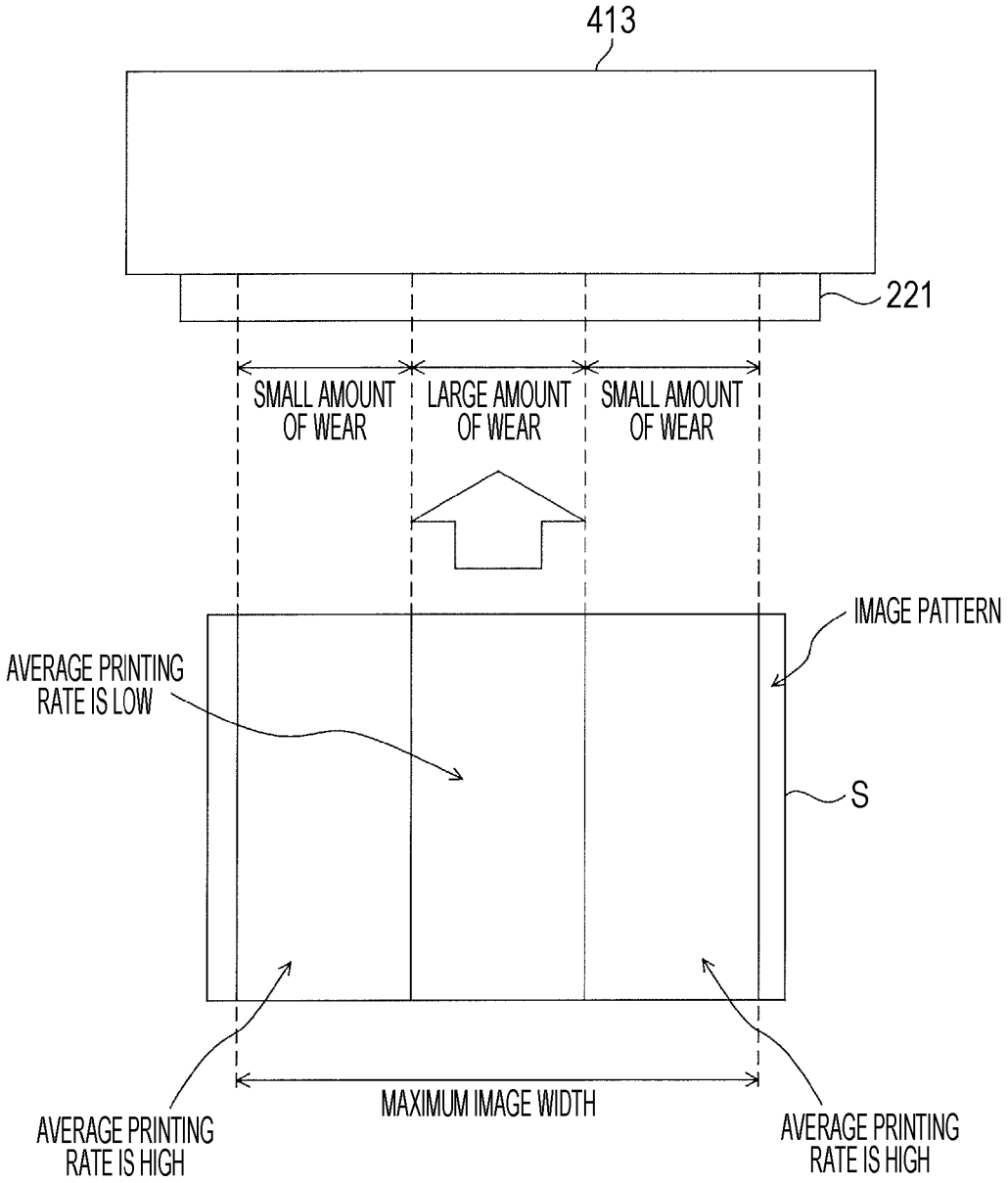
FIG. 5 is a diagram for describing a wear state of the fixing roller in a case of an image pattern having a partially different printing rate in an axial direction of a photoconductor drum.

FIG. 5 is a diagram for describing the wear state of the fixing roller 221 in a case of an image pattern having a partially different printing rate in the axial direction of the photoconductor drum 413 (the width direction of the sheet S).

A case of continuously forming an image of an image pattern having a printing rate partially greatly different in the width direction, for example, as illustrated in FIG. 5, a case of continuously forming an image of an image pattern having a low printing rate at a central portion and a high printing rate at both end portions in the width direction will be considered as an example. In this case, the amount of wear of the fixing roller 221 in the width direction varies depending on the level of the printing rate in the width direction. Specifically, the amount of wear of a portion of the fixing roller 221 corresponding to both the end portions having a high printing rate is small, and the amount of wear of a portion of the fixing roller 221 corresponding to the central portion having a low printing rate is large. As a result, the amount of lubricant on the photoconductor drum 413 becomes non-uniform in the width direction, and noise is generated in the formed image. In addition, when the amount of lubricant on the photoconductor drum 413 becomes non-uniform in the width direction, the wear of the cleaning blade 101 also becomes non-uniform in the width direction, and unevenness in the cleaning by the cleaning blade 101 in the width direction is caused.

Therefore, the image width of an image to be formed is divided into the plurality of divided regions in the axial direction of the photoconductor drum 413, and the average of the printing rate in each of the divided regions (partial printing rate) is stored. Referring to FIG. 5 as an example, the maximum image width of the image to be formed is divided into three divided regions, which are the central portion and the both end portions, in the axial direction of the photoconductor drum 413 (the width direction of the sheet S), and the partial printing rate in each of the divided regions, which are the central portion and the both end portions, is stored. Similarly to the first modification, the ordinal number of sheets at which the first refresh operation is executed (the moving distance of the photoconductor drum 413) is set according to the partial printing rate (see FIG. 11). When a partial printing rate in one of the three divided regions and the number of sheets satisfy, for example, conditions illustrated in FIG. 11, it is estimated that there is a large difference in the partial printing rates in the plurality of divided regions, and the fixing roller 221 is non-uniformly worn.

As described above, in the present modification, the controller 70 estimates whether the fixing roller 221 is non-uniformly worn based on the moving distance of the photoconductor drum 413 and the partial printing rates in the plurality of divided regions. When it is estimated that the fixing roller 221 is non-uniformly worn, the first refresh operation of the above embodiment is executed.

According to the present modification configured as described above, since the wear state of the fixing roller 221 is estimated in consideration of the average printing rates in the plurality of divided regions, it is possible to estimate that the fixing roller 221 is worn non-uniformly in the width direction. Since the first refresh operation of the above embodiment is executed based on this estimation, it is possible to obtain an effect similar to that of the above embodiment. Furthermore, in the case of the present modification, since it is estimated that the fixing roller 221 is worn non-uniformly in the width direction, it is possible to prevent the amount of lubricant on the photoconductor drum 413 from being non-uniform in the width direction, and to suppress generation of noise in the formed image.

<Third Modification>

In the above embodiment, the controller 70 rotates the fixing roller 221 by the predetermined angle to bring the unused region of the fixing roller 221 into contact with the photoconductor drum 413.

Unlike the above embodiment, in the present modification, the fixing roller 221 is rotated in consideration of the nip width of the fixing roller 221, and the present modification has a configuration similar to that in the above embodiment. Specifically, in the present modification, an angle at which the fixing roller 221 is rotated is obtained based on the nip width of the fixing roller 221, and the fixing roller 221 is rotated based on the obtained angle.

Figure 6:
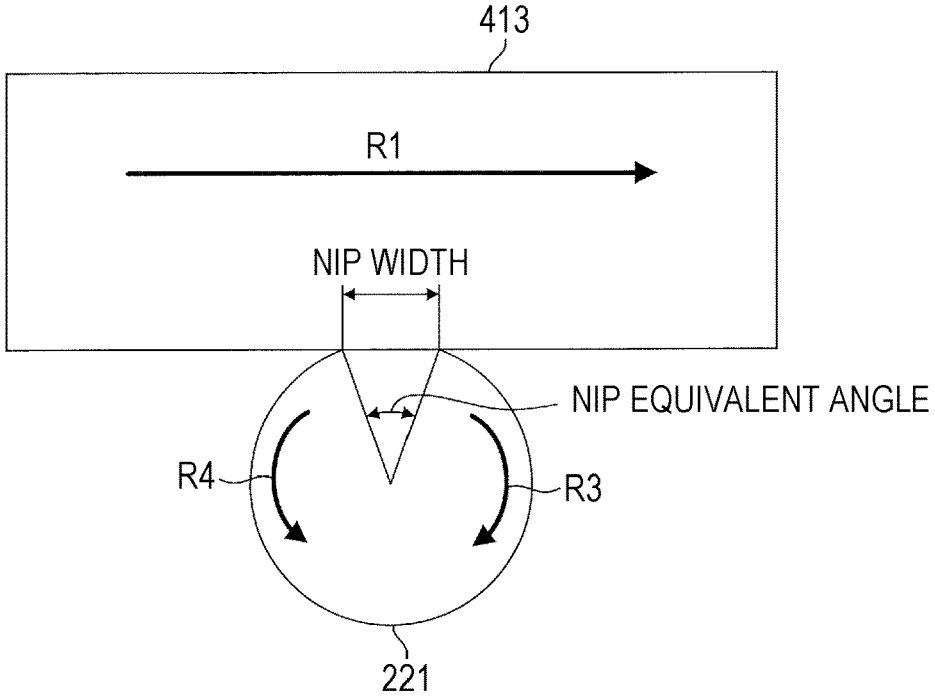
FIG. 6 is a diagram for describing an angle at which the fixing roller is rotated.

FIG. 6 is a diagram for describing the angle at which the fixing roller 221 is rotated. When the fixing roller 221 is pressed against and brought into contact with the photoconductor drum 413, the contact nip is formed between the fixing roller 221 and the photoconductor drum 413, and the contact nip has a predetermined nip width. The controller 70 has the nip width in advance, and also has a nip equivalent angle of the fixing roller 221 corresponding to the nip width in advance. The controller 70 rotates the fixing roller 221 by the nip equivalent angle when executing the first refresh operation. In the present modification, the fixing roller 221 may be rotated in either the rotation direction R3 or R4.

Rotating the fixing roller 221 by the nip equivalent angle in this manner can bring an unused region of the fixing roller 221 adjacent to the current contact nip into contact with the photoconductor drum 413. As a result, the entire circumference of the fixing roller 221 can be used without omission, and the life of the fixing roller 221 is longer than in the above embodiment, and the life of the fixing member can be extended.

As described above, in the present modification, the controller 70 rotates the fixing roller 221 by the angle corresponding to the nip width of the contact nip when executing the first refresh operation.

According to the present modification configured as described above, when the first refresh operation is executed, the fixing roller 221 is rotated by the angle corresponding to the nip width of the contact nip, and thus it is possible to obtain an effect similar to that of the above embodiment. Furthermore, in the case of the present modification, the entire circumference of the fixing roller 221 can be used without omission, and the life of the fixing roller 221 can be further extended.

<Fourth Modification>

In the above embodiment, the fixing roller 221 rotated by the controller 70 is rotatable in either the rotation direction R3 or R4 as illustrated in FIG. 3.

Unlike the above embodiment, in the present modification, the rotation direction of the fixing roller 221 is controlled in consideration of the printing rate of the image formed on the sheet via the photoconductor drum 413, and the present modification has a configuration similar to that in the above embodiment. Specifically, in the present modification, when the average printing rate in the axial direction of the photoconductor drum 413 (the width direction of the sheet S) is lower than a predetermined printing rate, the fixing roller 221 is rotated in the rotation direction R3, which is a rotation direction opposite to the rotation direction R1 of the photoconductor drum 413. In other words, in this case, the fixing roller 221 is rotated in the rotation direction R3 such that the fixing roller 221 moves in the same direction as a direction in which the photoconductor drum 413 moves at the contact nip (following rotation). On the other hand, when the average printing rate is equal or higher than the predetermined printing rate, the fixing roller 221 is rotated in the rotation direction R4, which is the same rotation direction as the rotation direction R1 of the photoconductor drum 413. In other words, in this case, the fixing roller 221 is rotated in the rotation direction R4 such that the fixing roller 221 moves in a direction opposite to the direction in which the photoconductor drum 413 moves at the contact nip (counter rotation).

The reason for controlling the rotation direction of the fixing roller 221 will be described below. After reaching the fixing roller 221, the lubricant supplied onto the photoconductor drum 413 is fixed (formed into a film) by the fixing roller 221 and passes through the fixing roller 221 at a certain percentage, and is dammed by the fixing roller 221 and is deposited on the fixing roller 221 at the remaining percentage. The lubricant deposited on the fixing roller 221 may fall due to gravity depending on arrangement of the fixing roller 221, and the lubricant may be wastefully consumed. As described above, the lubricant deposited on the fixing roller 221 causes a decrease in lubricant supply efficiency, and thus if the lubricant deposited on the fixing roller 221 can be reused, the lubricant supply efficiency can be improved.

However, the lubricant deposited on the fixing roller 221 also includes the external additive of the toner that has passed through the cleaning blade 101. When a ratio of the external additive of the toner contained in the deposited lubricant is high, reusing such a lubricant is likely to cause the external additive of the toner to hinder entry of the lubricant into the contact nip of the fixing roller 221. For this reason, a ratio of the amount of lubricant fixed by the fixing roller 221 and passing through the fixing roller 221 to the amount of supplied lubricant decreases, and the lubricant supply efficiency decreases.

Therefore, in the present modification, the rotation direction of the fixing roller 221 is controlled in consideration of the printing rate of the formed image, and when the ratio of the external additive of the toner contained in the deposited lubricant is low, such a lubricant can be reused.

Figure 7:
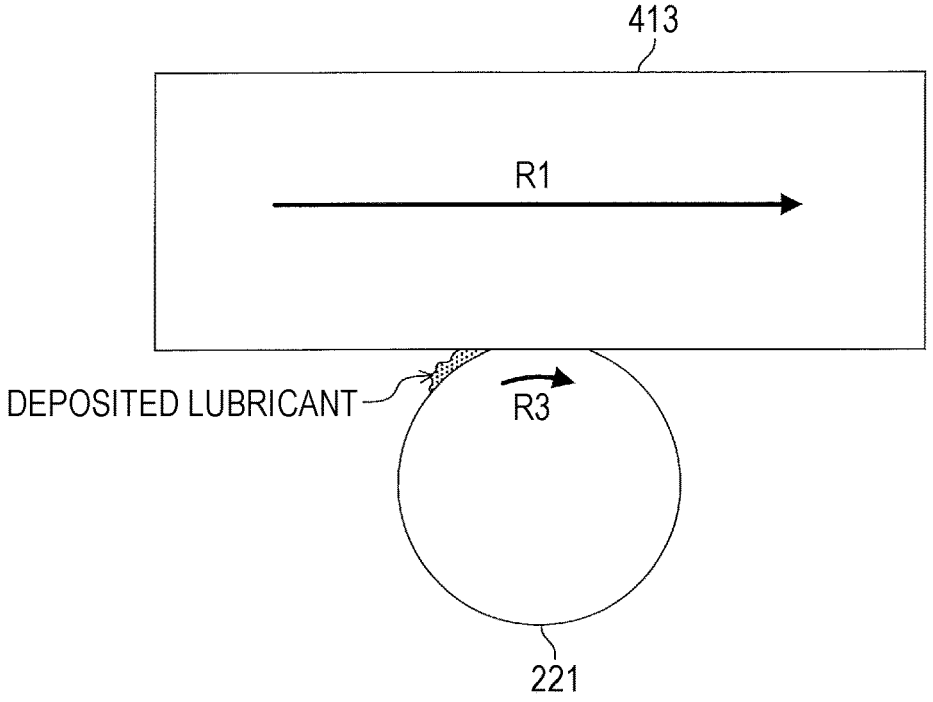
FIG. 7 is a diagram for describing a case where the fixing roller is rotated such that the fixing roller moves in the same direction as a direction in which the photoconductor drum moves at a contact nip between the photoconductor drum and the fixing roller.

Specifically, when the amount of the external additive of the toner reaching the fixing roller 221 is smaller than a predetermined amount of the external additive, for example, when the average printing rate is lower than the predetermined printing rate, the fixing roller 221 is rotated as illustrated in FIG. 7. That is, when the first refresh operation is executed, as illustrated in FIG. 7, the fixing roller 221 is rotated in the rotation direction R3 in which the fixing roller 221 moves in the same direction as the direction in which the photoconductor drum 413 moves at the contact nip. As a result, the lubricant deposited on the fixing roller 221, which has a small amount of the external additive, can be sent to the vicinity of the upstream side of the contact nip in the rotation direction R1. That is, the lubricant deposited on the fixing roller 221, which has the small amount of the external additive, can be reused, and the lubricant supply efficiency can be improved.

Figure 8:
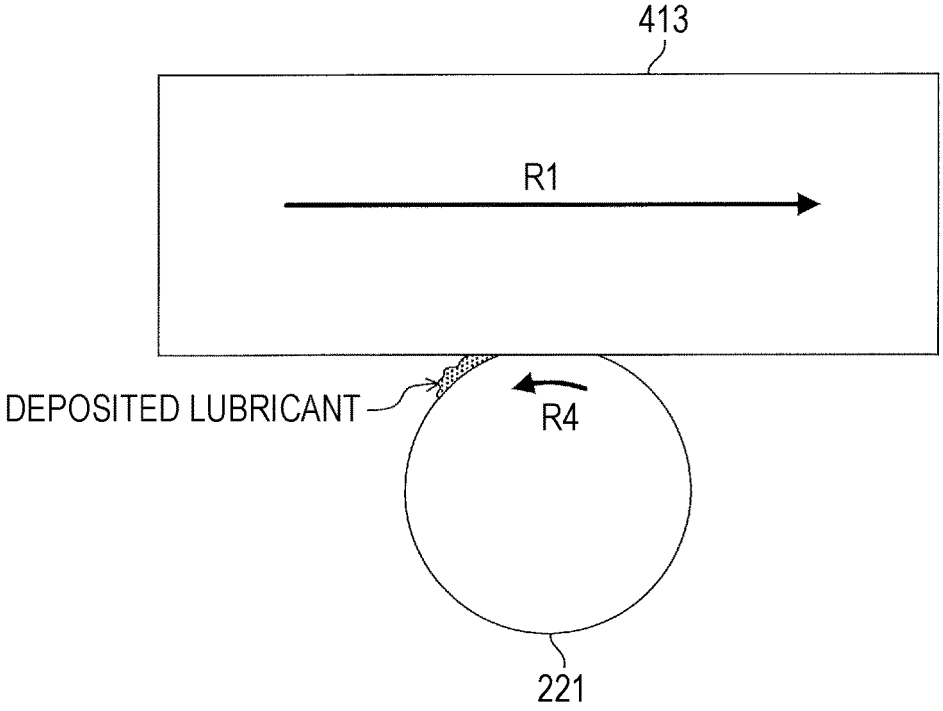
FIG. 8 is a diagram for describing a case where the fixing roller is rotated such that the fixing roller moves in a direction opposite to the direction in which the photoconductor drum moves at the contact nip between the photoconductor drum and the fixing roller.

On the other hand, when the amount of the external additive of the toner reaching the fixing roller 221 is equal to or larger than the predetermined amount of the external additive, for example, when the average printing rate is equal to or higher than the predetermined printing rate, the fixing roller 221 is rotated as illustrated in FIG. 8. That is, when the first refresh operation is executed, as illustrated in FIG. 8, the fixing roller 221 is rotated in the rotation direction R4 in which the fixing roller 221 moves in the direction opposite to the direction in which the photoconductor drum 413 moves at the contact nip. As a result, the lubricant deposited on the fixing roller 221, which has a large amount of the external additive, is prevented from being sent to the vicinity of the upstream side of the contact nip in the rotation direction R1. That is, the lubricant deposited on the fixing roller 221, which has the large amount of the external additive, is prevented from being reused, and thus the external additive is prevented from hindering the entry of the lubricant into the contact nip, so that a decrease in the lubricant supply efficiency is suppressed.

As described above, in the present modification, the controller 70 controls the rotation direction of the fixing roller 221 according to the printing rate of the formed image.

According to the present modification configured as described above, since the rotation direction of the fixing roller 221 is controlled according to the printing rate of the formed image, it is possible to obtain an effect similar to that of the above embodiment. Furthermore, in the case of the present modification, when the average printing rate is lower than the predetermined printing rate, the fixing roller 221 is rotated in the rotation direction R3 in which the fixing roller 221 moves in the same direction as the direction in which the photoconductor drum 413 moves at the contact nip, and thus the lubricant with the small amount of the external additive can be reused. As a result, it is possible to improve the lubricant supply efficiency. Furthermore, when the average printing rate is equal to or higher than the predetermined printing rate, the fixing roller 221 is rotated in the rotation direction R4 in which the fixing roller 221 moves in the direction opposite to the direction in which the photoconductor drum 413 moves at the contact nip, and thus the lubricant with the large amount of the external additive can be prevented from being reused. As a result, it is possible to prevent the external additive from hindering the entry of the lubricant into the contact nip, and to suppress a decrease in the lubricant supply efficiency.

Note that, here, the average printing rate in the axial direction of the photoconductor drum 413 (the width direction of the sheet S) is used as the printing rate of the image, but another numerical value, for example, a deviation from a reference value or the like may be used as long as the numerical value is an equivalent statistical numerical value.

<Fifth Modification>

In the above embodiment, the fixing device 220 includes the fixing roller 221 and the drive mechanism (such as the motor) that controls and drives the rotation of the fixing roller 221.

Unlike the above embodiment, in the present modification, the fixing device 220 includes a cleaning member that cleans a surface of the fixing roller 221 in addition to the configuration in the above embodiment. The cleaning member will be described later with reference to FIG. 9.

In a high-temperature and high-humidity environment, when the operation (rotation) of the photoconductor drum 413 is stopped for a long time after the image forming processing, a discharge product from the charging device 414 falls on a part of the photoconductor drum 413 in a circumferential direction for a long time. Since the discharge product is hydrophilic, the part of the photoconductor drum 413 on which the discharge product has fallen has reduced resistance, which causes image noise during image formation. In such a case, it is effective to execute a second refresh operation of refreshing the photoconductor drum 413, which will be described below. The second refresh operation is different from the first refresh operation of refreshing the fixing roller 221 in that the photoconductor drum 413 is refreshed.

In the present modification, in the second refresh operation, the photoconductor drum 413 and the fixing roller 221 are rotated for a predetermined time, and the fixing roller 221 collects the discharge product on the photoconductor drum 413 together with the lubricant. As the predetermined time, a time during which the discharge product can be collected from the part of the photoconductor drum 413 on which the discharge product has fallen is set.

Furthermore, in the second refresh operation, the controller 70 rotates the fixing roller 221 in the rotation direction R4, which is the same rotation direction as the rotation direction R1 of the photoconductor drum 413, in order to improve collectability of the discharge product. In other words, the fixing roller 221 is rotated in the rotation direction R4 such that the fixing roller 221 moves in the direction opposite to the direction in which the photoconductor drum 413 moves at the contact nip.

Figure 9:
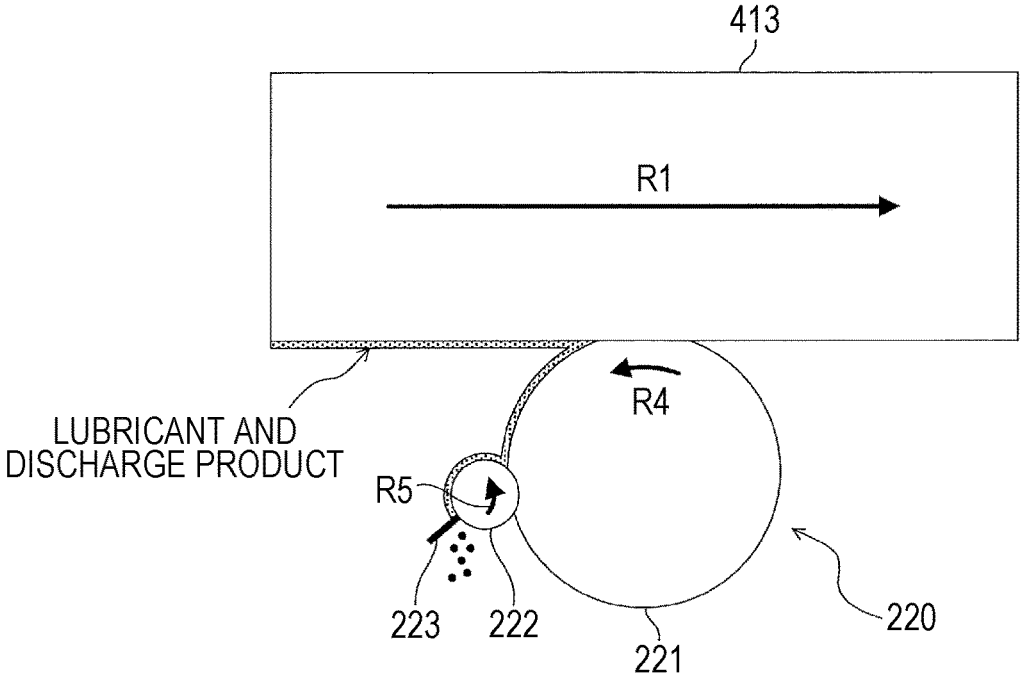
FIG. 9 is a diagram illustrating another example (fifth modification) of a fixing device.

Here, FIG. 9 is a diagram illustrating the fixing device 220 of the present modification. In the present modification, the fixing device 220 includes a cleaning brush 222 (cleaning member) for cleaning the fixing roller 221, and a flicking plate 223 for cleaning the cleaning brush 222. The cleaning brush 222 is brought into contact with the fixing roller 221 and rotates in a rotation direction R5, which is the same rotation direction as the rotation direction R4 of the fixing roller 221, thereby cleaning (removing) the discharge product and the lubricant on the fixing roller 221. That is, the cleaning brush 222 is rotated in the rotation direction R5 such that the cleaning brush 222 moves in a direction opposite to a direction in which the fixing roller 221 moves at a contact portion between the fixing roller 221 and the cleaning brush 222 (counter rotation). Furthermore, the flicking plate 223 is brought into contact with the cleaning brush 222, thereby cleaning (removing) the discharge product and the lubricant adhering to the cleaning brush 222.

Note that the second refresh operation is incorporated into a startup sequence at the time of restarting (at the time of resuming) the image forming apparatus 1, and thus, there is no influence on productivity as long as the second refresh operation can be ended, for example, in a time equal to or shorter than a warm-up time of the fixation unit 60.

As described above, in the present modification, the fixing device 220 includes the cleaning brush 222 (cleaning member) that cleans the fixing roller 221. The controller 70 determines whether to execute the second refresh operation of refreshing the photoconductor drum 413 according to a stop time of the photoconductor drum 413 and an environment around the photoconductor drum 413 at the time of stopping the photoconductor drum 413. When the stop time of the photoconductor drum 413 and the environment around the photoconductor drum 413 at the time of stopping the photoconductor drum 413 satisfy a predetermined condition (a condition under which the discharge product is generated), the second refresh operation is executed, so that the fixing roller 221 collects the discharge product on the photoconductor drum 413 together with the lubricant.

According to the present modification configured as described above, since the fixing roller 221 collects the discharge product on the photoconductor drum 413 together with the lubricant, it is possible to restore the resistance of the photoconductor drum 413 to normal resistance, and to suppress the generation of the image noise during image formation.

Note that, as the environment around the photoconductor drum 413, the temperature, the humidity, and the like around the photoconductor drum 413 may be considered.

EXAMPLES

With respect to the above embodiment, the present inventors implemented Examples and Comparative Example and evaluated Examples and Comparative Example as described below.

In the evaluation, the above embodiment was implemented as Example 1, the above first modification was implemented as Example 2, the above second modification was implemented as Example 3, the above fourth modification was implemented as Example 4, and the above fifth modification was implemented as Examples 5 and 6. For comparison with these, a fixing device 310 illustrated in FIG. 10 was implemented as Comparative Example 1.

The fixing device 310 illustrated in FIG. 10 includes the fixing blade 311 whose end portion is brought into contact with the surface of the photoconductor drum 413, and a support sheet metal 312 to which the fixing blade 311 is attached and that supports the fixing blade 311. Note that, in FIG. 10, configurations of the cleaning device 100 and the lubricant supplier 210 are as described above, and thus a description thereof will be omitted.

Common conditions of Examples and Comparative Example are as follows.

Process speed: 400 mm/s

Cleaning blade 101 (material: polyurethane, rubber hardness: 70°, thickness: 2 mm, contact force: 30 N/m, contact angle: 20°)

Lubricant rod 211 (material: ZnSt, pressing force: 5 N)

Brush 212 (outer diameter: 14 mm, material: acryl, fineness: 3 d, density: 150 KF/inch, pushing depth to photoconductor: 1 mm, counter rotation)

Note that 150 KF/inch means that 150,000 fibers are implanted per square inch.

Configurations of Examples and Comparative Example are as Follows

Examples 1 to 6

Fixing roller 221 (outer diameter: 13 mm, core metal diameter: 8 mm, pushing depth to photoconductor: 0.5 mm, nip width: 5.2 mm)

Elastic layer 221*b* (thickness: 2 mm, material: urethane sponge, hardness: 20° (Asker C)) Surface layer 221*c* (material: polyurethane, thickness: 0.5 mm)

Comparative Example 1

Fixing blade 311 (material: polyurethane, rubber hardness: 65°, thickness: 1.5 mm, pushing depth to photoconductor: 0.5 mm, trail, contact angle α: 50°)

[Contents of Implementation]

Contents of implementation in Examples are as follows.

Example 1

The first refresh operation was executed each time 200K sheets of A4 size were printed in a lateral direction. At this time, the fixing roller 221 was rotated such that the unused region of the fixing roller 221 was brought into contact with the photoconductor drum 413 and served as the contact nip. Specifically, the fixing roller 221 was rotated in the rotation direction R4 in which the fixing roller 221 moved in the direction opposite to the direction in which the photoconductor drum 413 moved at the contact nip (counter rotation).

Example 2

Each time 100K sheets of A4 size were printed in the lateral direction, the average printing rate of the entire image forming region during printing of 100K sheets was calculated and stored. The first refresh operation was executed based on the average printing rate and the total number of printed sheets, for example, according to the conditions in a table illustrated in FIG. 11. For example, in a case where the average printing rate of the entire image forming region was lower than 10%, the first refresh operation was executed when the total number of printed sheets having the average printing rate lower than 10% reached 100K. In addition, for example, in a case where the average printing rate of the entire image forming region was equal to or higher than 10%, the first refresh operation was executed when the total number of printed sheets having the average printing rate equal to or higher than 10% reached 200K. In the first refresh operation itself, as in Example 1, the fixing roller 221 was rotated in the rotation direction R4 such that the unused region of the fixing roller 221 was brought into contact with the photoconductor drum 413 and served as the contact nip (counter rotation). In addition, the total number of printed sheets at each average printing rate was reset after the first refresh operation was executed.

Example 3

Here, as illustrated in FIG. 12, the maximum image width was divided into nine areas in the axial direction of the photoconductor drum 413 (the width direction of the sheet S), and nine divided regions were set. Each time 100K sheets of A4 size were printed in the lateral direction, the average printing rate for each divided region during printing of 100K sheets was calculated and stored. In the nine divided regions, when an average printing rate in at least one divided region satisfied the conditions in the table illustrated in FIG. 11, the first refresh operation was executed. In the first refresh operation itself, as in Example 1, the fixing roller 221 was rotated in the rotation direction R4 such that the unused region of the fixing roller 221 was brought into contact with the photoconductor drum 413 and served as the contact nip (counter rotation). In addition, the total number of printed sheets at each average printing rate was reset after the first refresh operation was executed.

Example 4

Each time 100K sheets of A4 size were printed in the lateral direction, the average printing rate of the entire image forming region during printing of 100K sheets was calculated and stored. The first refresh operation was executed based on the average printing rate and the total number of printed sheets, for example, according to the conditions in a table illustrated in FIG. 11. When the first refresh operation was executed, an average value of the average printing rate of the entire image forming region (entire section average value of the average printing rate) from a completion of a previous first refresh operation to a start of a current first refresh operation was calculated. The rotation direction of the fixing roller 221 was controlled based on the entire section average value of the average printing rate. For example, according to conditions of a table illustrated in FIG. 13, when the entire section average value of the average printing rate was lower than 30%, the following rotation was made, and when the entire section average value of the average printing rate was equal to or higher than 30%, the counter rotation was made as in Example 1. As described in the fourth modification (see also FIG. 7), the term "following rotation" means that the fixing roller 221 is rotated in the rotation direction (rotation direction R3) in which the fixing roller 221 moves in the same direction as the direction in which the photoconductor drum 413 moves at the contact nip. In addition, the total number of printed sheets at each average printing rate was reset after the first refresh operation was executed.

Example 5

In Example 5, configurations of the cleaning brush 222 and the flicking plate 223 are as follows.

Cleaning brush 222 (outer diameter: 11 mm, material: polyethylene terephthalate (PET), fineness: 6 d, density: 100 KF/inch, pushing depth to photoconductor: 1 mm, counter rotation)

Flicking plate 223 (material: stainless steel, thickness 1 mm, pushing depth to cleaning brush: 1 mm)

In a high-temperature and high-humidity environment, after the image forming processing, the image forming apparatus was left for eight hours or more in a state where the rotation of the photoconductor drum 413 was stopped, and the second refresh operation was executed as a startup sequence after the lapse of eight hours. As the second refresh operation, after the start of the image forming apparatus, the following rotation of the fixing roller 221 was made for 30 seconds at 0=1.5 while the photoconductor drum 413 was rotated before the image forming operation (0 is a speed ratio between the photoconductor drum 413 and the fixing roller 221).

Example 6

As in Example 5, the second refresh operation was executed. In Example 6, the counter rotation of the fixing roller 221 was made for 30 seconds at 0=0.5.

Comparative Example 1

The first refresh operation and the second refresh operation described above were not executed.

[Evaluation Method]

Examples 1 to 6 and Comparative Example 1 described above were evaluated as follows.

Comparative Example 1, Examples 1 to 4

In an N-N environment (temperature: 20° C., humidity: 50%), 400K sheets of A4 size were printed in the lateral direction by use of image charts of lateral bands with an average printing rate of 5%, lateral bands with an average printing rate of 20%, and longitudinal bands (see FIG. 14, average printing rate: 60%). A full-surface halftone image (printing rate: 40%) was printed each time 100K sheets of A4 size were printed in the lateral direction, and density fluctuation from an initial image density and image noise were evaluated. In FIGS. 15A and 15B, ○ indicates a level at which there is no problem in use, Δ indicates a level at which there is no problem in use, but that is inferior to ○, and x indicates a level at which there is a problem in use. In addition, a consumption amount from an initial lubricant weight was evaluated by a ratio (initial weight−weight after endurance)/initial weight×100[%].

Comparative Example 1, Examples 5 and 6

In an H-H environment (temperature: 30° C., humidity: 80%), the image forming apparatus was turned off immediately after 5K sheets of A4 size were printed in the lateral direction by use of the image chart of the lateral bands with the average printing rate of 5%. The image forming apparatus was started after eight hours, and the full-surface halftone image (printing rate: 40%) was continuously printed on 50 sheets of A3 size in a vertical direction, and the evaluation was performed based on the number of sheets required for image noise to disappear.

[Evaluation Results]

Evaluation results of Examples 1 to 6 and Comparative Example 1 described above are as follows.

Comparative Example 1

At the time of printing of 100K sheets, the image density fluctuations in the image charts of the lateral bands with the average printing rate of 5% and the longitudinal bands with the average printing rate of 60% were at the level of Δ. At the time of printing of 200K sheets, the image density fluctuation in the image chart of the lateral bands with the average printing rate of 5% and the image density fluctuation and the image noise in the image chart of the longitudinal bands with the average printing rate of 60% were at the level of x. Since the wear of the fixing blade 311 progresses rapidly at a low printing rate, the amount of lubricant on the photoconductor drum 413 decreases due to insufficient fixing of the lubricant. Therefore, the image density is reduced due to influence of frictional charging in the developing device 412. In the image chart of the longitudinal bands with the average printing rate of 60%, a difference in the amount of lubricant between band portions and a non-band portion illustrated in FIG. 14 causes the image noise. At the time of printing of 300K sheets, even the image density fluctuation in the image chart of the lateral bands with the average printing rate of 20% was at the level of x (see FIGS. 15A and 15B).

Example 1

At the time of printing of 100K, the image density fluctuations in the image charts of the lateral bands with the average printing rate of 5% and the longitudinal bands with the average printing rate of 60% were at the level of Δ, as in Comparative Example 1. However, since the first refresh operation was executed at the time of printing of 200K sheets, the image quality was not at the level of x (see FIGS. 15A and 15B).

Example 2

At the time of printing 100K sheets, only the image density fluctuation and the image noise in the image chart of the longitudinal bands with the average printing rate of 60% were at the level of Δ, but since the first refresh operation was executed, the image density fluctuation in the image chart of the lateral bands with the average printing rate of 5% was at the level of ○. Therefore, the image quality level was improved as compared with Example 1 (see FIGS. 15A and 15B).

Example 3

In the image chart of the longitudinal bands with the average printing rate of 60%, since there was a large difference in the partial printing rates in the plurality of divided regions, the first refresh operation was executed at the time of printing of 100K sheets. Thus, even the image density fluctuation and the image noise in the image chart of the longitudinal bands with the average printing rate of 60% were at the level of ○. The image quality level was further improved as compared with Example 2 (see FIGS. 15A and 15B).

Example 4

Since the following rotation of the fixing roller 221 was made in the first refresh operation when the average printing rate was lower than 30%, the lubricant deposited on the fixing roller 221 could be reused. Therefore, a lubricant consumption rate could be reduced by 6 to 10% as compared with Example 2, which was implemented under equivalent conditions except for the rotation direction of the fixing roller 221 in the first refresh operation (see FIGS. 15A and 15B).

Examples 5 and 6

In Examples 5 and 6 in which the second refresh operation was executed, since the discharge product on the photoconductor drum 413 was collected by the fixing roller 221, the number of sheets required for the image noise to disappear was reduced as compared with Comparative Example 1 (see FIG. 16).

From the evaluation results of Examples 1 to 6 and Comparative Example 1 described above, it has been confirmed that, according to the present invention, the deterioration in the quality of the formed image can be suppressed.

Although embodiments of the present invention have been described and illustrated in detail, the disclosed embodiments are made for purposes of illustration and example only and not limitation. The scope of the present invention should be interpreted by terms of the appended claims That is, the present invention can be implemented in various forms without departing from its gist or its main features.

What is claimed is:

1. An image forming apparatus comprising:

a lubricant supplier that supplies a lubricant onto an image carrier;

a fixing member that is rotatable, and comes into contact with the image carrier to fix the lubricant supplied onto the image carrier; and a hardware processor that controls rotation of the fixing member, wherein the hardware processor stops the rotation of the fixing member when the lubricant is fixed by the fixing member.

2. The image forming apparatus according to claim 1, wherein the fixing member has a cylindrical shape.

3. The image forming apparatus according to claim 1, wherein the fixing member includes an elastic member.

4. An image forming apparatus comprising:

a lubricant supplier that supplies a lubricant onto an image carrier;

a fixing member that is rotatable, and comes into contact with the image carrier to fix the lubricant supplied onto the image carrier; and a hardware processor that controls rotation of the fixing member, wherein the hardware processor executes a first refresh operation of rotating the fixing member.

5. The image forming apparatus according to claim 4, wherein the hardware processor rotates, in the first refresh operation, the fixing member to bring a region different from a contact region of the fixing member in contact with the image carrier into contact with the image carrier.

6. The image forming apparatus according to claim 5, wherein the hardware processor rotates the fixing member by an angle corresponding to the contact region.

7. The image forming apparatus according to claim 4, wherein the hardware processor rotates the fixing member when it is estimated that a contact region of the fixing member in contact with the image carrier is worn.

8. The image forming apparatus according to claim 4, wherein the hardware processor rotates the fixing member according to a moving distance of the image carrier.

9. The image forming apparatus according to claim 4, wherein the hardware processor rotates the fixing member according to a moving distance of the image carrier and printing rate information regarding a printing rate of an image formed on a sheet via the image carrier.

10. The image forming apparatus according to claim 9, wherein the hardware processor uses, as the printing rate information, an average of the printing rate of the image in an axial direction of the image carrier.

11. The image forming apparatus according to claim 9, wherein the hardware processor uses, as the printing rate information, a partial printing rate in each of divided regions set by dividing the image in an axial direction of the image carrier.

12. The image forming apparatus according to claim 4, wherein the hardware processor rotates the fixing member in a same direction as a direction in which the image carrier moves.

13. The image forming apparatus according to claim 12, wherein the hardware processor rotates the fixing member in the same direction as the direction in which the image carrier moves when a printing rate of an image formed on a sheet via the image carrier is lower than a predetermined printing rate.

14. The image forming apparatus according to claim 4, wherein the hardware processor rotates the fixing member in a direction opposite to a direction in which the image carrier moves.

15. The image forming apparatus according to claim 14, wherein the hardware processor rotates the fixing member in the direction opposite to the direction in which the image carrier moves when a printing rate of an image formed on a sheet via the image carrier is equal to or higher than a predetermined printing rate.

16. An image forming apparatus comprising:

a lubricant supplier that supplies a lubricant onto an image carrier;

a fixing member that is rotatable, and comes into contact with the image carrier to fix the lubricant supplied onto the image carrier; and a hardware processor that controls rotation of the fixing member, wherein the hardware processor executes a refresh operation of rotating the fixing member for a predetermined time together with movement of the image carrier.

17. The image forming apparatus according to claim 16, wherein the hardware processor determines whether to rotate the fixing member according to a movement stop time of the image carrier and an environment around the image carrier when the image carrier is stopped.

18. The image forming apparatus according to claim 16, wherein the hardware processor rotates, in the refresh operation, the fixing member in a direction opposite to a direction in which the image carrier moves.

19. The image forming apparatus according to claim 18, further comprising a cleaning member that cleans the fixing member.

* * * * *